US011762412B2

(12) United States Patent
Spink

(10) Patent No.: US 11,762,412 B2
(45) Date of Patent: Sep. 19, 2023

(54) JOYSTICK DEVICE WITH HAPTIC FEEDBACK

(71) Applicant: APEM, Caussade (FR)

(72) Inventor: Howard Spink, Winchester (GB)

(73) Assignee: APEM, Caussade (FR)

( * ) Notice: Subject to any disclaimer, the term of this patent is extended or adjusted under 35 U.S.C. 154(b) by 0 days.

(21) Appl. No.: 17/843,893

(22) Filed: Jun. 17, 2022

(65) Prior Publication Data

US 2022/0404855 A1 Dec. 22, 2022

(30) Foreign Application Priority Data

Jun. 21, 2021 (EP) ..... 21305853

(51) Int. Cl.
*G05G 5/05* (2006.01)
*G05G 9/047* (2006.01)

(52) U.S. Cl.
CPC ..... *G05G 5/05* (2013.01); *G05G 9/047* (2013.01); *G05G 2009/04725* (2013.01)

(58) Field of Classification Search
CPC ..... G05G 2009/04725
See application file for complete search history.

(56) References Cited

U.S. PATENT DOCUMENTS 4,646,087 A * 2/1987 Schumann ..... G01D 5/2073 340/870.31
5,140,313 A * 8/1992 Wen ..... G05G 9/047 345/161

FOREIGN PATENT DOCUMENTS

JP H07190177 A 7/1995
JP 2010211321 A 9/2010
WO WO-2014090702 A1 6/2014

OTHER PUBLICATIONS

European Search Report dated Nov. 20, 2022 in App. No. EP 21305853.

* cited by examiner

*Primary Examiner* — Vicky A Johnson
(74) *Attorney, Agent, or Firm* — MARSHALL, GERSTEIN & BORUN LLP

(57) ABSTRACT

A joystick device 10 disclosed herein provides a return function for urging a lever 20 to its initial position. The device includes a first spring 30 and a second spring 40, each of which extends along the lever 20 and is disposed between an upper spring seat 32 and a lower spring seat 34. The springs 30 and 40 are subjected to compression to provide an urging force as the lever 20 is tilted from the initial position.

4 Claims, 6 Drawing Sheets

JOYSTICK DEVICE WITH HAPTIC FEEDBACK

CROSS REFERENCE TO RELATED APPLICATIONS

The benefit of priority to European Patent Application No. 21305853.0 filed Jun. 21, 2021, is hereby claimed and the disclosure is incorporated here in by reference in its entirety.

FIELD OF THE INVENTION

The present invention relates to a joystick device for controlling a target device in correspondence with displacement of a joystick lever. The present invention in particular relates to such a joystick device for giving a haptic feedback to an operator.

BACKGROUND OF THE INVENTION

Joystick devices are used to control a variety of devices or vehicles in response to operation of a joystick lever. Displacement of the lever with respect to a reference axis is detected and converted to generate a control signal for manipulation of the control target. In use, it is advantageous that the operator receives a haptic response from the joystick lever.

It is also known that such joystick devices provide a return function for safety reasons. With this feature, once the operation force is released from the joystick lever, the joystick lever returns to its initial position in order to prevent a possible incident involving an operational error.

For example, JP 2010 211321 A discloses a joystick controller for providing a kick-down effect by increasing a required operation force when the lever is tilted to a predetermined degree. The joystick controller is provided with a lower spring and an upper spring disposed one above the other along the lever. The lower spring is disposed between a lower spring seat and an intermediate spring seat. The upper spring is disposed between the intermediate spring seat and an upper spring seat. The lower spring is compressed and always urges the lever to return to its initial position. On the other hand, the upper spring is compressed to provide a return force against the operation force only when an inclination of the lever reaches the predetermined degree. The compression of the upper spring is triggered by contact between the intermediate spring seat and a stopper formed on a joystick housing and by further tilting of the lever. With this configuration, the operator can sense an increased resistance when the upper spring starts to be compressed and become aware of a possible risk of the device being damaged by further tilting the lever.

Those teachings would, however, result in an increased height of the joystick device and also pose constraint on the housing and/or spring seat designs. Therefore, joystick devices that have a simple and compact structure and involve a minimum constraint on design choice are in demand.

SUMMARY OF THE INVENTION

According to the present application, there is provided a joystick device as defined in the appended claims. Specifically, there is disclosed a joystick device for providing a haptic feedback, comprising: a lever configured to be pivotally movable about a rotational center point from an initial position in which the lever extends along a central axis; a first spring seat attached to the lever; a second spring seat attached to the lever at a position between the first spring seat and the rotational center point and configured to move toward the first spring seat as the lever is tilted from the central axis; a first spring extending along the lever between the first spring seat and the second spring seat and configured to be subjected to compression and urge the lever to the initial position as the second spring seat moves toward the first spring seat; and a second spring separate from the first spring and extending along the lever, wherein the second spring is disposed between the first spring seat and the second spring seat and configured to be subjected to compression and urge the lever to the initial position as the second spring seat moves toward the first spring seat.

The joystick device may further comprise a third spring seat attached to the lever at a position between the first spring seat and the second spring seat, the third spring seat being configured to form a gap between the third spring seat and the second spring seat when the lever is in the initial position, wherein the first spring has one end attached to the first spring seat and another end attached to the second spring seat, wherein the second spring has one end attached to the first spring seat and another end attached to the third spring seat, and wherein the second spring is configured to be subjected to compression when the lever is tilted to a triggering position, in which the second spring seat comes into contact with the third spring seat, and tilted further from the triggering position.

The joystick device may further comprise: a first stopper fixedly attached to the lever and configured to disallow the first spring seat to move away from the rotational center point beyond the first stopper; and a second stopper fixedly attached to the lever at a position between the first stopper and the rotational center point and configured to disallow the third spring seat to move toward the rotational center point beyond the second stopper.

The joystick device may be configured such that the second spring seat comprises an extension extending along the lever toward the third spring seat, the extension being configured to come into contact with the third spring seat when the lever is in the triggering position.

The joystick device may be configured such that the second spring is subjected to a pre-load by being compressed between the first spring seat and the third spring seat.

The joystick device may be configured such that the first spring has one end attached to the first spring seat and the other end attached to the second spring seat, wherein the second spring has one end attached to the first spring seat and the other end attached to the second spring seat.

The joystick device may be configured such that the second spring is disposed between the first spring and the lever.

The joystick device may be configured such that the first spring and the second spring are coil springs, wherein the second spring extends about the lever and the first spring extends about the second spring.

The joystick device may further comprise at least one further spring extending along the lever, the at least one further spring being disposed between the first spring seat and the second spring seat and configured to be subjected to compression and urge the lever to the initial position as the lever is tilted from the central axis.

The joystick device disclosed herein comprises two springs disposed between the common spring seats. Therefore, the additional spring does not increase the height of the joystick device. Also, the joystick device of the present disclosure does not require contact between the spring seat and the housing in order to realize a stepwise increase in a haptic feedback. This allows for flexible housing and/or spring seat designs. Furthermore, according to the present disclosure, a fail-safe effect can be realized by employing the dual springs design as both of the springs provide a return-to-center function.

BRIEF DESCRIPTION OF THE FIGURES

Embodiments of the invention will be described in further detail with reference to the accompanying drawings, in which.

DETAILED DESCRIPTION OF EMBODIMENTS OF THE INVENTION

Figure 1:
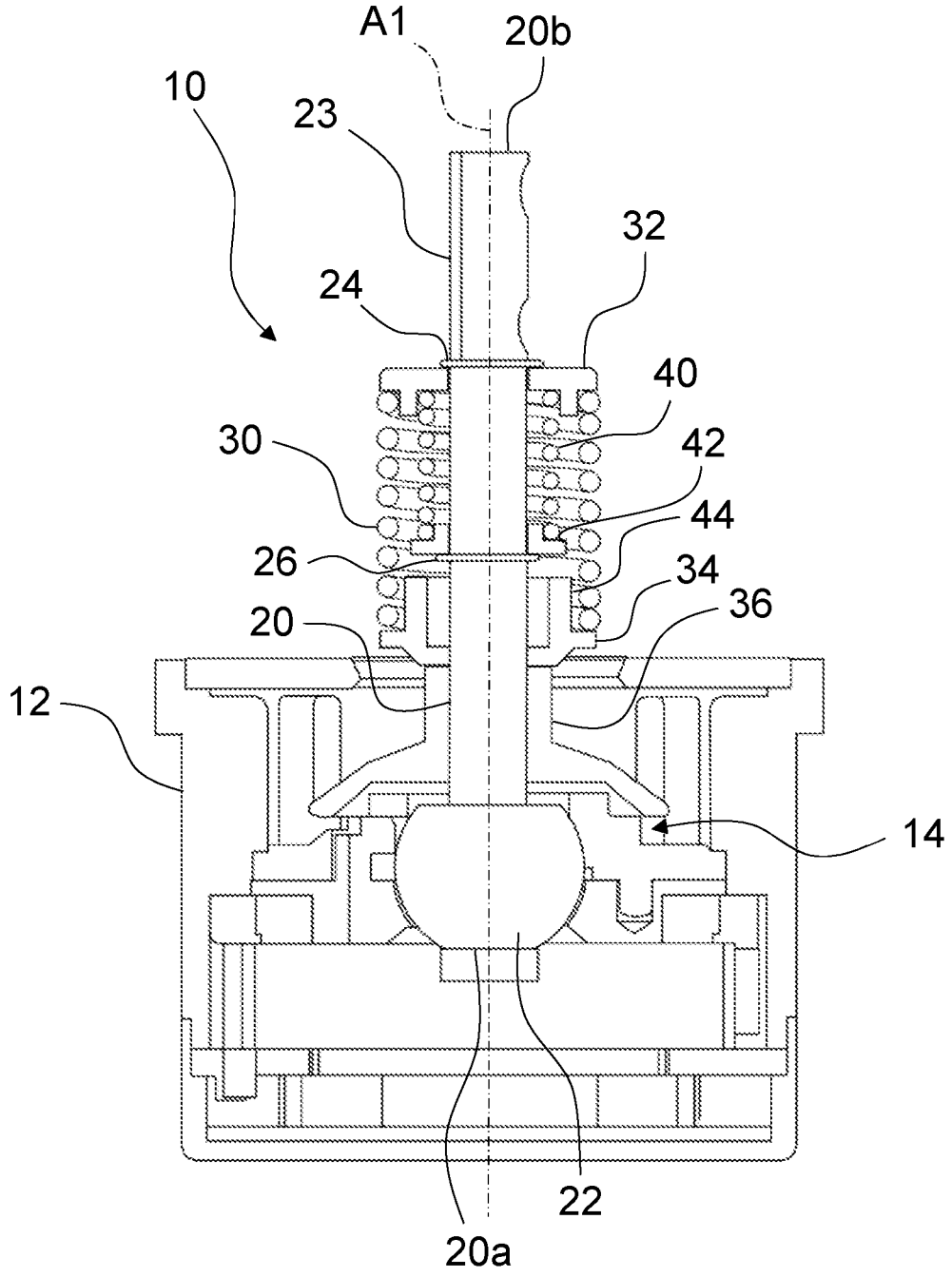
FIG. 1 shows a joystick device according to an embodiment when a joystick lever is in an initial position with no operation force being applied to the lever.

Referring to FIG. 1, a joystick device 10 according to an embodiment will be described below. The joystick device 10 comprises of a base housing 12 and a lever 20 sticking out of the base housing 12 for allowing an operator to put a hand on the lever 20 in order to control a target entity.

The lever 20 is an elongated shaft. When no external force is applied to the lever 20, or in other words when the lever 20 is in an "initial position" or in a "home position", the lever 20 extends along a central axis A1, as shown in FIG. 1.

The lever 20 has a foot 22 at its proximal end 20*a*. The foot 22 is rotatably held within the base housing 12 in such a way that the lever 20 is pivotally movable about the foot 22. With the aid of the foot 22, the lever 20 can be tilted in any direction around the central axis A1 from the initial position in response to an operation force applied by the operator.

The lever 20 has an operation portion 23 near a distal end 20*b* opposite the proximal end 20*a*. The operation portion 23 extends over a portion starting from the distal end 20*b* of the lever 20. The operation portion 23 may be ergonomically designed to provide for a better grip with a hand of the operator.

Although no further detail is provided herein, the joystick device 10 cooperates with a displacement sensor (not illustrated) for detecting displacement of the lever 20 and a controller (not illustrated) for controlling a target entity in response to the displacement of the lever 20 detected by the sensor.

The joystick device 10 is equipped with a return mechanism in the form of dual springs. The return mechanism provides an urging force to the lever 20 toward the initial position, thereby allowing the lever 20 to return to the initial position as soon as an external force is released from the lever 20. The return mechanism according to this embodiment comprises a first spring 30, a second spring 40, and a base actuator 36.

The base actuator 36 provided above the foot 22 of the lever 20. The base actuator 36 generally has a truncated pyramidal or conical shape with a central opening through which the lever 20 extends. The base actuator 36 is configured to be slidable along the lever 20 via the opening. The base actuator 36 is engageable with a cam 14 formed inside the base housing 12 and configured to move away from the proximal end 20*a* of the lever 20 as the lever 20 is tilted from the central axis A1.

The first spring 30 and the second spring 40 may be respectively a coil spring. Each of the first spring 30 and the second spring 40 extends about the lever 20. The second spring 40 is provided radially inside the first spring 30.

More specifically, the first spring 30 is provided to extend along the lever 20 between an upper spring seat 32, or a first spring seat, and a lower spring seat 34, or a second spring seat. The first spring 30 has one end attached to the upper spring seat 32 and another end attached to the lower spring seat 34. The respective spring seats 32 and 34 have an opening through which the lever 20 extends and configured to be slidable along the lever 20 via the opening.

The lever 20 is provided with an upper stopper 24, or a first stopper, that is fixedly attached to the lever 20 at a position immediately below the operation portion 23. The upper stopper 24 has a larger diameter than the opening of the upper spring seat 32 and thus prevents movement of the upper spring seat 32 beyond the upper stopper 24 toward the distal end 20*b* of the lever 20.

The lower spring seat 34 is provided above and in contact with the base actuator 36. Movement of the lower spring seat 34 toward the proximal end 20*a* of the lever 20 is restricted by the base actuator 36, while movement of the lower spring seat 34 in the opposite direction, i.e., toward the distal end 20*b* of the lever 20, is made possible. The lower spring seat 34 has an extension 44 in the form of a tube extending away from the base actuator 36. The extension 44 has a smaller diameter than the first spring 30 in such a way that the extension 44 extends radially inside the first spring 30.

The second spring 40 is provided to extend along the lever 20 between the upper spring seat 32 and an intermediate spring seat 42, or a third spring seat. The intermediate spring seat 42 is disposed at a position between the upper spring seat 32 and the lower spring seat 34. The second spring 40 has one end attached to the upper spring seat 32 and another end attached to the intermediate spring seat 42. The intermediate spring seat 42 has an opening through which the lever 20 extends and configured to be slidable along the lever 20 via the opening.

When the lever 20 is in the initial position, the intermediate spring seat 42 rests on a lower stopper 26, or a second stopper, which is fixedly attached to the lever 20 at a predetermined distance from the upper stopper 24 toward the proximal end 20*a* of the lever 20. The lower stopper 26 has a larger diameter than the opening of the intermediate spring seat 42, thereby preventing movement of the intermediate spring seat 42 beyond the lower stopper 26.

Also, when the lever 20 is in the initial position, there is a gap along the lever 20 between the intermediate spring seat 42 and the lower spring seat 34. As described later, the extension 44 of the lower spring seat 34 has an inner diameter larger than the lower stopper 26, thereby enabling movement of the extension 44 beyond the lower stopper 26.

The first spring 30 is configured and disposed to be subjected to a pre-load when the lever 20 is in the initial position. Likewise, the second spring 40 is configured and disposed to be subjected to a pre-load when the lever 20 is in the initial position.

Figure 2:
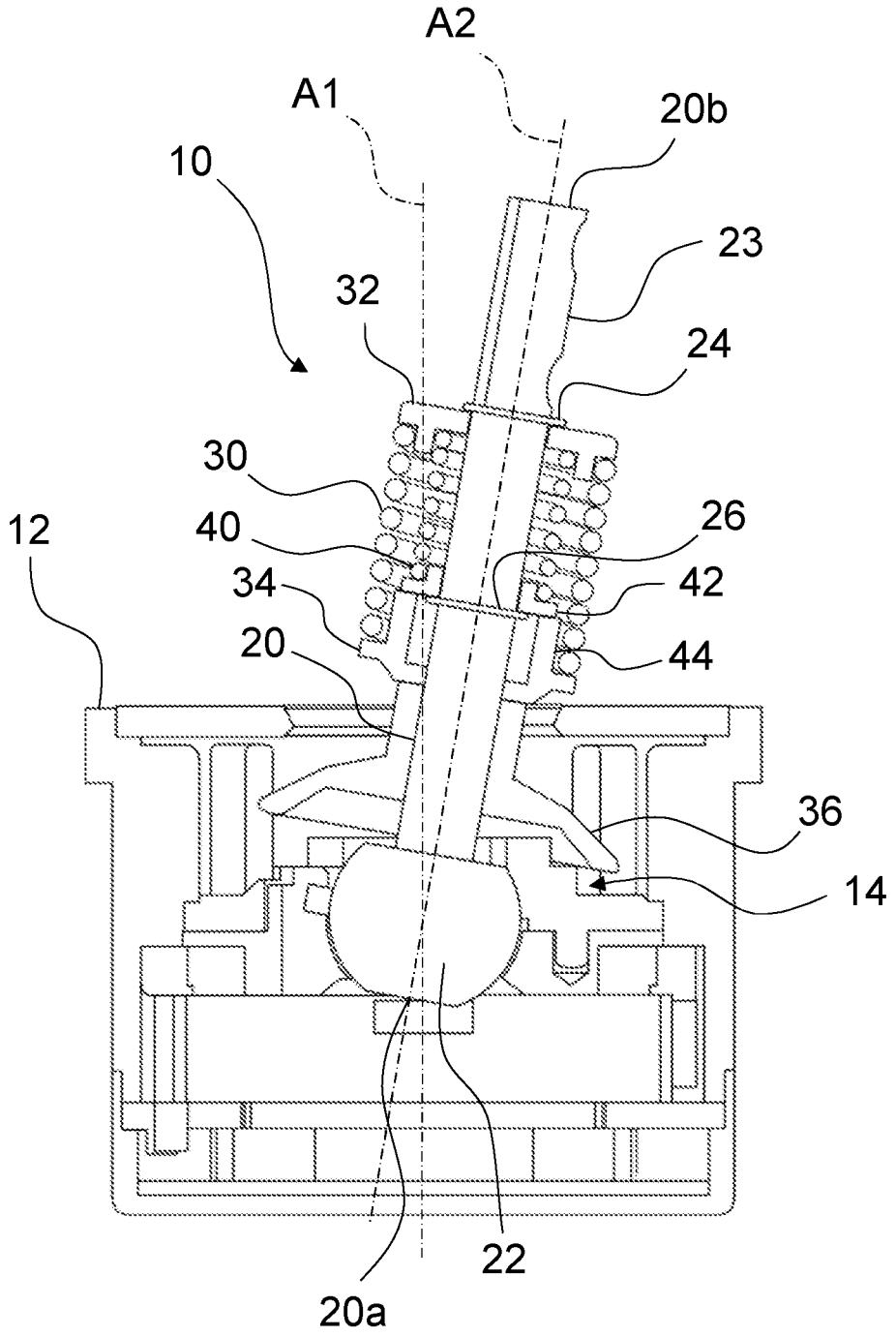
FIG. 2 shows the joystick device of FIG. 1 when the lever is tilted to a triggering position.

Next, operation using the joystick device 10 will be described with further reference to FIGS. 2 and 3 in addition to FIG. 1.

When the operator applies an operation force to the lever 20 of the joystick device 10, the lever 20 is tilted from the initial position about the foot 22 serving as a rotational center. The base actuator 36 then moves upward along the lever 20 (i.e., in a direction away from the proximal end 20*a* of the lever 20) as a result of engagement with the cam 14, pushing the lower spring seat 34 upward.

Since the upper spring seat 32 cannot move beyond the upper stopper 24, the first spring 30 is subjected to compression as the lower spring seat 34 moves toward the upper spring seat 32. At this stage, the intermediate spring seat 42 still rests on the lower stopper 26 as there is a gap between the intermediate spring seat 42 and the lower spring seat 34. Thus, the second spring 40 is not subjected to compression. If the operation force is released from the lever 20, the lever 20 returns to the initial position due to the urging force exerted by the first spring 30.

If the lever 20 is tilted further from the central axis A1, the lever 20 reaches a triggering position. In the triggering position as shown in FIG. 2, the lever 20 comes to extend along a triggering axis A2 forming a predetermined angle with respect to the central axis A1. In the triggering position, the extension 44 of the lower spring seat 34 comes into contact with the intermediate spring seat 42.

Figure 3:
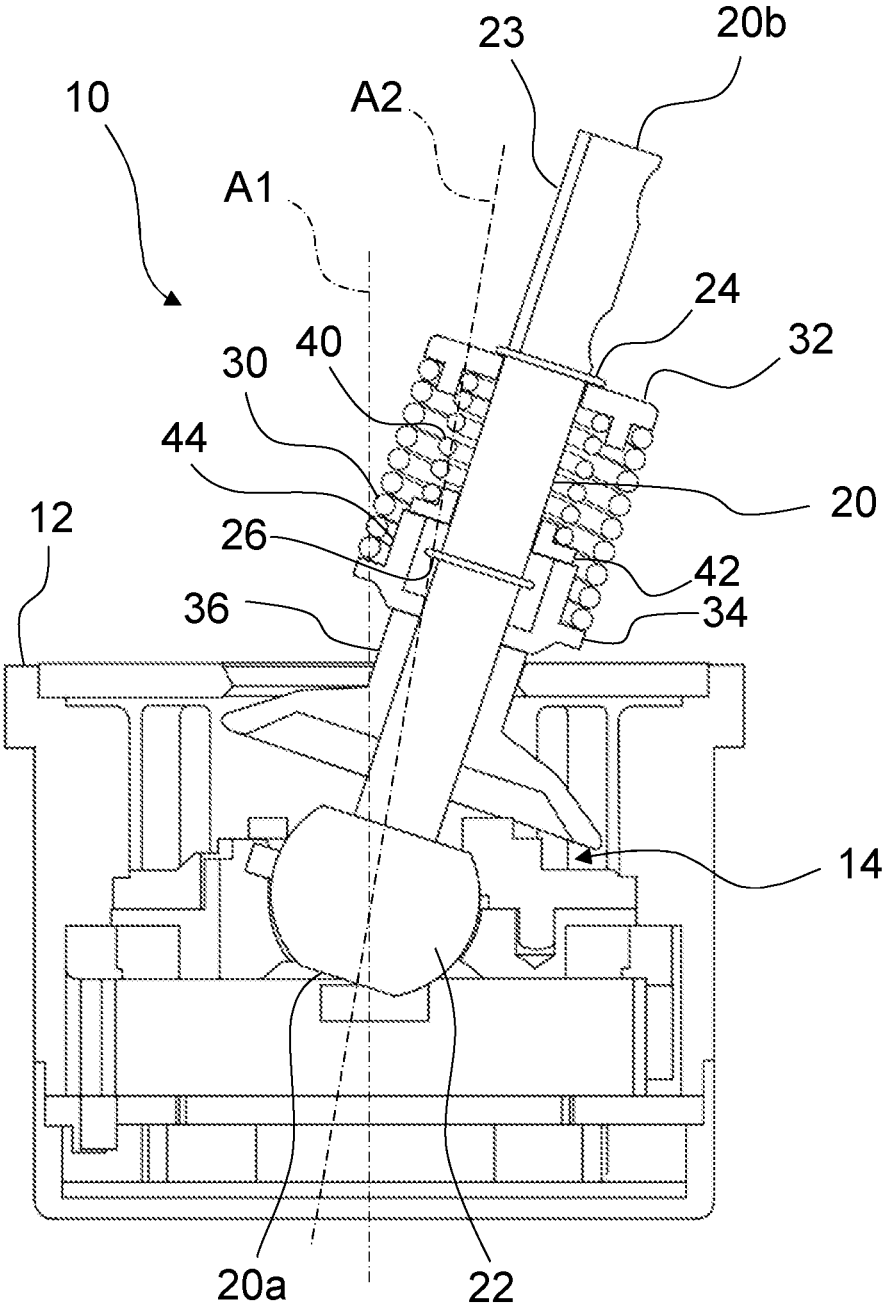
FIG. 3 shows the joystick device of FIG. 1 when the lever is tilted further from the triggering position.

As shown in FIG. 3, if the tilting angle of the lever 20 further increases from the angle in the triggering position, the second spring 40 is subjected to compression as the intermediate spring seat 42 moves toward the upper spring seat 32, urging the lever 20 toward the initial position. If the operation force is released from the lever 20, the lever 20 returns to the initial position due to the combination of the urging forces exerted by the first spring 30 and the second spring 40.

Figure 4:
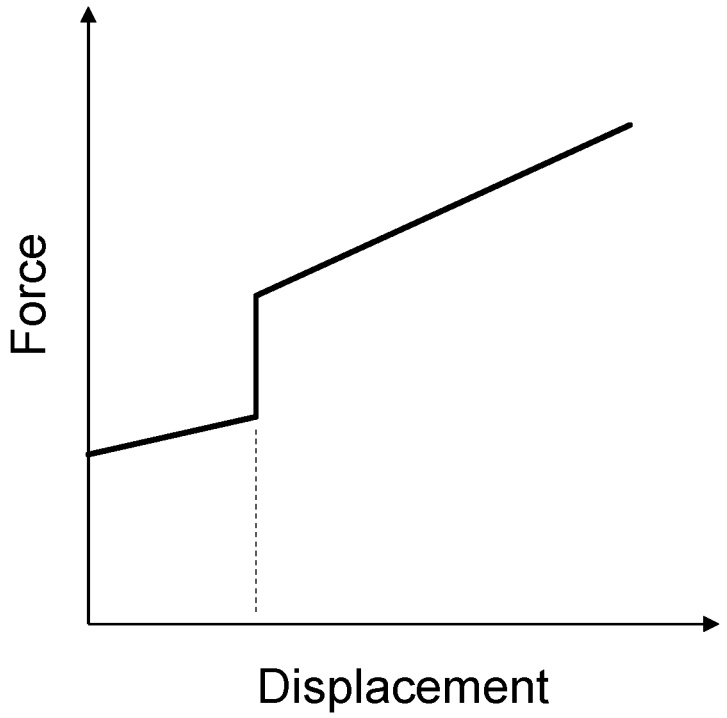
FIG. 4 is a graph showing a relationship between a displacement amount of the lever and a reaction force exerted by the lever.

Referring to FIG. 4, a haptic feedback to be provided by the joystick device 10 will be described. As illustrated, when displacement of the lever 20 from the initial position is relatively small, a reaction force exerted by the return mechanism increases proportionally to the amount of displacement. When the lever 20 reaches the triggering position as shown by the dashed line in the drawing, the second spring 40 starts being compressed, whereby the reaction force increases in a stepwise manner. As the lever 20 is tilted further from the triggering position, the reaction force again increases proportionally to the amount of displacement, but more steeply, since the operator has to apply an operation force against an urging force of the second spring 40 as well as the first spring 30. Due to the stepped increase in reaction force that occurs when the lever 20 reaches the triggering position, the operator can have a detent-like feeling from the joystick device 10.

According to the embodiment, the lever 20 can safely return to the initial position by means of the return mechanism once the operation force is released. Since the first spring 30 and the second spring 40 are radially arranged one inside the other, the height of the joystick device 10 can be significantly reduced.

Moreover, the triggering position of the lever 20 is easily adjustable in the disclosed embodiment, for example, by changing the configuration(s) of the lower spring seat 34 and/or the base actuator 36. Since the compression of the first spring 30 and the second spring 40 are caused by the axial movement of the base actuator 36 along the lever 20, the joystick device 10 can provide a haptic feedback that accurately reflects the amount of displacement of the lever 20. Furthermore, unlike JP 2010 211321 A, the base housing 12 is not used to trigger compression of the second spring 40 according to the disclosed embodiment. Therefore, the housing design can be more flexible.

Furthermore, in case one of the first spring 30 and the second spring 40 can no longer provide a return function because of a damage or any other reasons, the other of the springs would still be able to provide the return function. In this way, a fail-safe measure can be realized.

Figure 5:
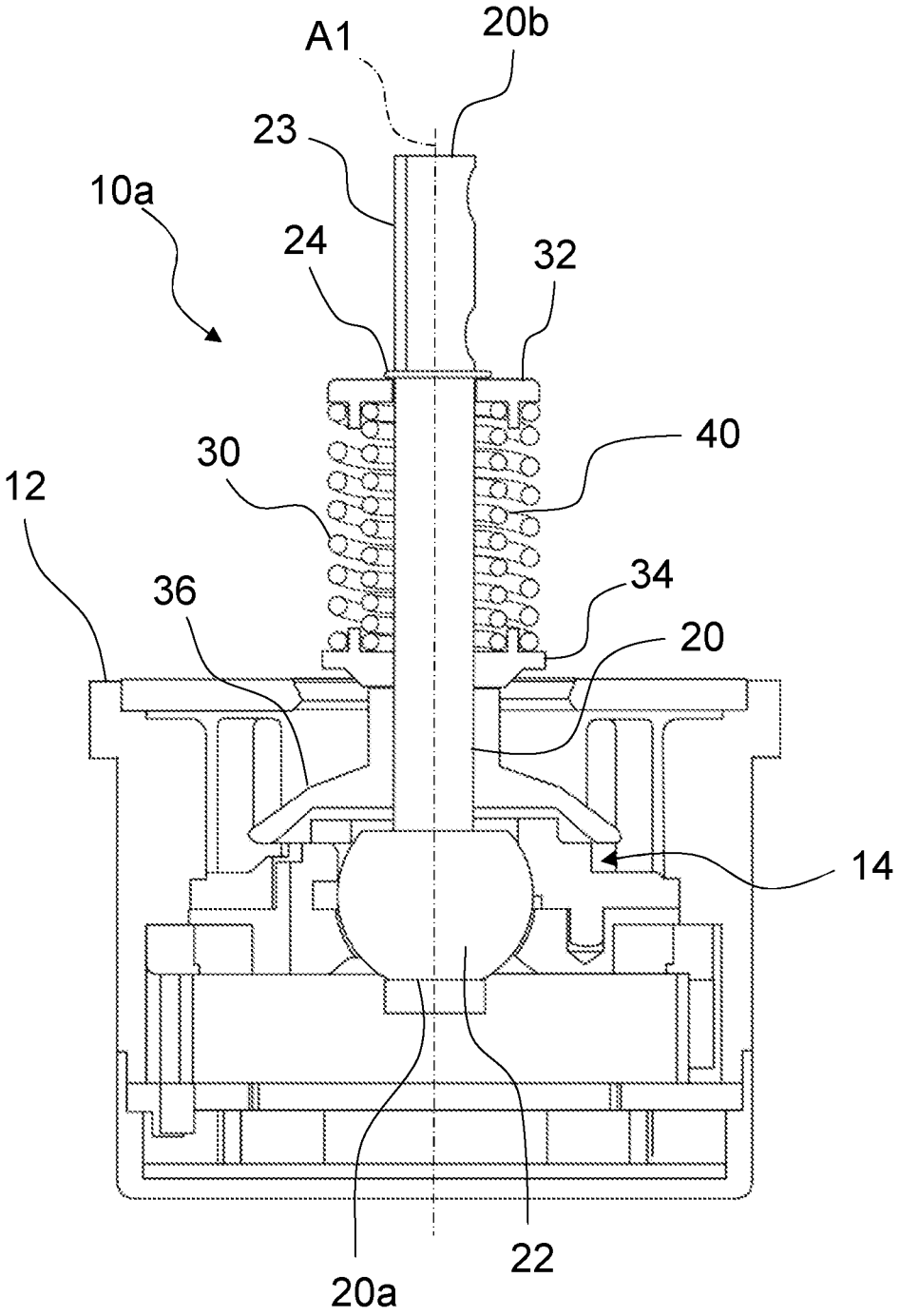
FIG. 5 shows a joystick device according to another embodiment when a joystick lever is in an initial position with no operation force being applied to the lever.
Figure 6:
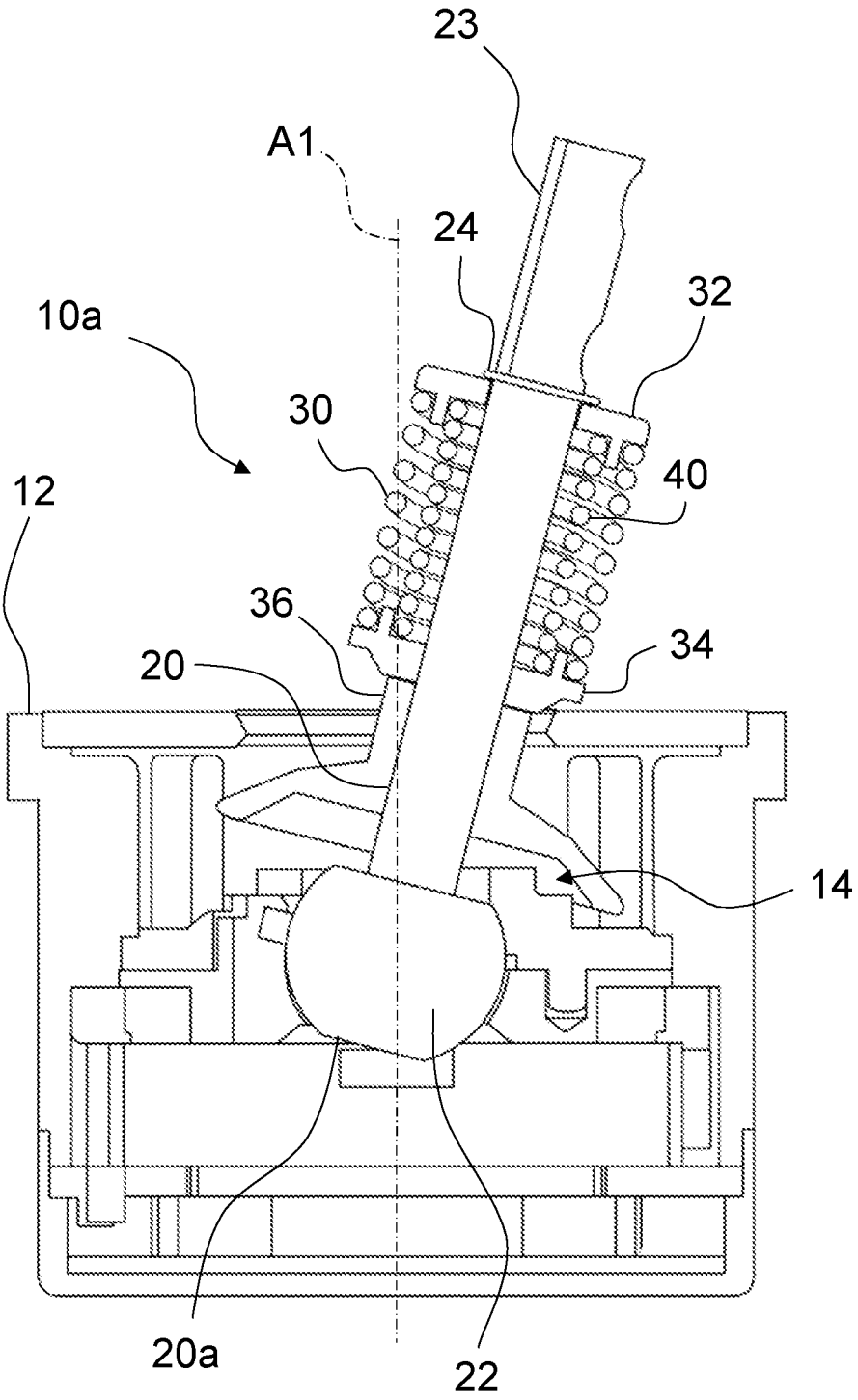
FIG. 6 shows the joystick device of FIG. 1 when the lever is tilted from the initial position.

Referring to FIGS. 5 and 6, a joystick device 10*a* according to another embodiment will be described. The joystick device 10*a* according to this embodiment differs from the joystick device 10 as described above in that the second spring 40 extends between the upper spring seat 32 and the lower spring seat 34. As illustrated, the second spring 40 has one end attached to the upper spring seat 32 and another end attached to the lower spring seat 34 in a similar manner as the first spring 30. The second spring 40 thus extends in parallel with the first spring 30 over the entire length along the lever 20.

According to this embodiment, additional use of the spring does not increase the height of the joystick device 10*a* because the second spring 40 is arranged radially inside the first spring 30. Further, the fail-safe effect can also be realized by the redundant design of the return mechanism.

Although not illustrated, one or more additional springs may be disposed to extend along the lever 20 between the upper spring seat 32 and the lower spring seat 34 to further strengthen a fail-safe function.

The invention claimed is:

1. A joystick device for providing a haptic feedback, comprising:

a lever configured to be pivotally movable about a rotational center point from an initial position in which the lever extends along a central axis;

a first spring seat attached to the lever;

a second spring seat attached to the lever at a position between the first spring seat and the rotational center point and configured to move toward the first spring seat as the lever is tilted from the central axis;

a first spring extending along the lever between the first spring seat and the second spring seat and configured to be subjected to compression and urge the lever to the initial position as the second spring seat moves toward the first spring seat; and a second spring separate from the first spring and extending along the lever, wherein the second spring is disposed between the first spring seat and the second spring seat and configured to be subjected to compression and urge the lever to the initial position as the second spring seat moves toward the first spring seat, wherein the joystick device further comprises a third spring seat attached to the lever at a position between the first spring seat and the second spring seat, the third spring seat being configured to form a gap between the third spring seat and the second spring seat when the lever is in the initial position, wherein the first spring has one end attached to the first spring seat and another end attached to the second spring seat, wherein the second spring has one end attached to the first spring seat and another end attached to the third spring seat, and wherein the second spring is configured to be subjected to compression when the lever is tilted to a triggering position, in which the second spring seat comes into contact with the third spring seat, and tilted further from the triggering position.

2. The joystick device of claim 1, further comprising:

a first stopper fixedly attached to the lever and configured to disallow the first spring seat to move away from the rotational center point beyond the first stopper; and a second stopper fixedly attached to the lever at a position between the first stopper and the rotational center point and configured to disallow the third spring seat to move toward the rotational center point beyond the second stopper.

3. The joystick device of claim 1, wherein the second spring seat comprises an extension extending along the lever toward the third spring seat, the extension being configured to come into contact with the third spring seat when the lever is in the triggering position.

4. The joystick device of claim 1, wherein the second spring is subjected to a pre-load by being compressed between the first spring seat and the third spring seat.

* * * * *